US008956268B2

(12) United States Patent
Huang et al.

(10) Patent No.: US 8,956,268 B2
(45) Date of Patent: Feb. 17, 2015

(54) REHABILITATION TREADMILL

(71) Applicant: Dyaco International Inc., Taipei (TW)

(72) Inventors: Hsuan-Fu Huang, Hemei Town, Changhua County (TW); Ching-Lung Liao, Hemei Town, Changhua County (TW)

(73) Assignee: Dyaco International Inc., Taipei (TW)

( * ) Notice: Subject to any disclaimer, the term of this patent is extended or adjusted under 35 U.S.C. 154(b) by 131 days.

(21) Appl. No.: 13/662,557

(22) Filed: Oct. 29, 2012

(65) Prior Publication Data

US 2014/0066263 A1 Mar. 6, 2014

(30) Foreign Application Priority Data

Sep. 5, 2012 (TW) ..... 101132413 A

(51) Int. Cl.
*A63B 22/00* (2006.01)
*A63B 21/00* (2006.01)

(52) U.S. Cl.
USPC ..... 482/54; 482/51

(58) Field of Classification Search
CPC ..... A63B 2220/13; A63B 22/0242; A63B 2024/0093; A63B 22/02; A63B 2022/025; A63B 22/0023; A63B 22/0257; A63B 24/00; A63B 2071/0081
USPC ..... 482/1–9, 54, 51
See application file for complete search history.

(56) References Cited

U.S. PATENT DOCUMENTS

| | | | | |
|---|---|---|---|---|
| 4,708,337 | A * | 11/1987 | Shyu | 482/54 |
| 6,179,754 | B1 * | 1/2001 | Wang et al. | 482/54 |
| 6,416,444 | B1 * | 7/2002 | Lim et al. | 482/54 |
| 7,153,241 | B2 * | 12/2006 | Wang | 482/54 |
| 8,480,541 | B1 * | 7/2013 | Brunts | 482/7 |
| 2009/0176629 | A1 * | 7/2009 | Yi | 482/54 |
| 2012/0173978 | A1 * | 7/2012 | Lee et al. | 715/716 |
| 2013/0267385 | A1 * | 10/2013 | Watterson et al. | 482/8 |

FOREIGN PATENT DOCUMENTS

| | | |
|---|---|---|
| TW | M294951 | 8/2006 |

* cited by examiner

*Primary Examiner* — Stephen Crow
(74) *Attorney, Agent, or Firm* — Huffman Law Group, PC

(57) ABSTRACT

A rehabilitation treadmill includes a running belt, a plurality of pace sensors mounted to two opposite sides of the running belt, and a control panel. When a user intends to do rehabilitation exercise via the rehabilitation treadmill, the pace sensors can detect the user's footstep to generate and transmitting an activation signal and a stop signal to the control panel and then the control panel can activate or stop the running belt subject to the activation or stop signal. In this way, the user can repeatedly put his or her feet on running belt alternately to effectively have the rehabilitational effect.

6 Claims, 6 Drawing Sheets

REHABILITATION TREADMILL

BACKGROUND OF THE INVENTION

1. Field of the Invention

The present invention relates generally to a rehabilitation treadmill and more particularly, to a treadmill for physical rehabilitation.

2. Description of the Related Art

A conventional treadmill allows a user to stand on the running belt with his or her feet and to keep stepping with the feet alternately along with the operation of the running belt for the body-building purpose. Since the running belt can keep rotation and its rotary speed can be adjusted, the treadmill is frequently chosen to be the apparatus for a particular patient's rehabilitation, especially for the patient who needs leg rehabilitation.

However, the operational speed of the aforesaid conventional treadmill can though be adjusted to the lowest speed subject to the user's need, but the running belt still keeps running, so the inconveniently mobile person may carelessly fall down because of the user's balance loss or other reasons. In this way, the user may suffer great injury. Therefore, the conventional treadmill tends to be worrying in safety for the patient in the process of rehabilitation.

SUMMARY OF THE INVENTION

The primary objective of the present invention is to provide a rehabilitation treadmill, which can be safely operated.

The foregoing objective of the present invention is attained by the rehabilitation treadmill composed of a framework, a running platform, at least one pair of pace sensors, and a control panel. The framework is put on the ground for supporting other components of the rehabilitation treadmill. The running platform is mounted to the framework and includes a running belt. The pace sensors are mounted to the framework and located at respective two sides of the running belt for generating a stop signal while detecting a pace stop point. The control panel is mounted to the framework and electrically connected with the treadmill and the pace sensors for receiving the stop signal and for controllably stopping the running belt according to the stop signal. When the user's footstep is moved to the pace stop point as the running belt is working, the running belt stops operation in such a way that the present invention can be preferably safely operated.

In a preferred embodiment of the present invention, the pace sensors can be one or two or more pairs in number and allow the user to configure different operation modes via the control panel subject to the user's need. For example, the user can randomly configure each of the two pairs of the pace sensors for detecting a pace start point or the pace stop point; or the user can configure one pair of the pace sensors for detecting the pace stop point and the other pairs of the pace sensors for detecting the pace start point; or the user can configure two pairs of the pace sensors among all of the pace sensors for detecting the pace start point and the pace stop point for different rehabilitational effects, respectively.

DETAILED DESCRIPTION OF PREFERRED EMBODIMENTS

Structural features and desired effects of a rehabilitation treadmill 10 of the present invention will become more fully understood by reference to a preferred embodiment given hereunder. However, it is to be understood that these embodiments are given by way of illustration only, thus are not limitative of the claim scope of the present invention.

Figure 1:
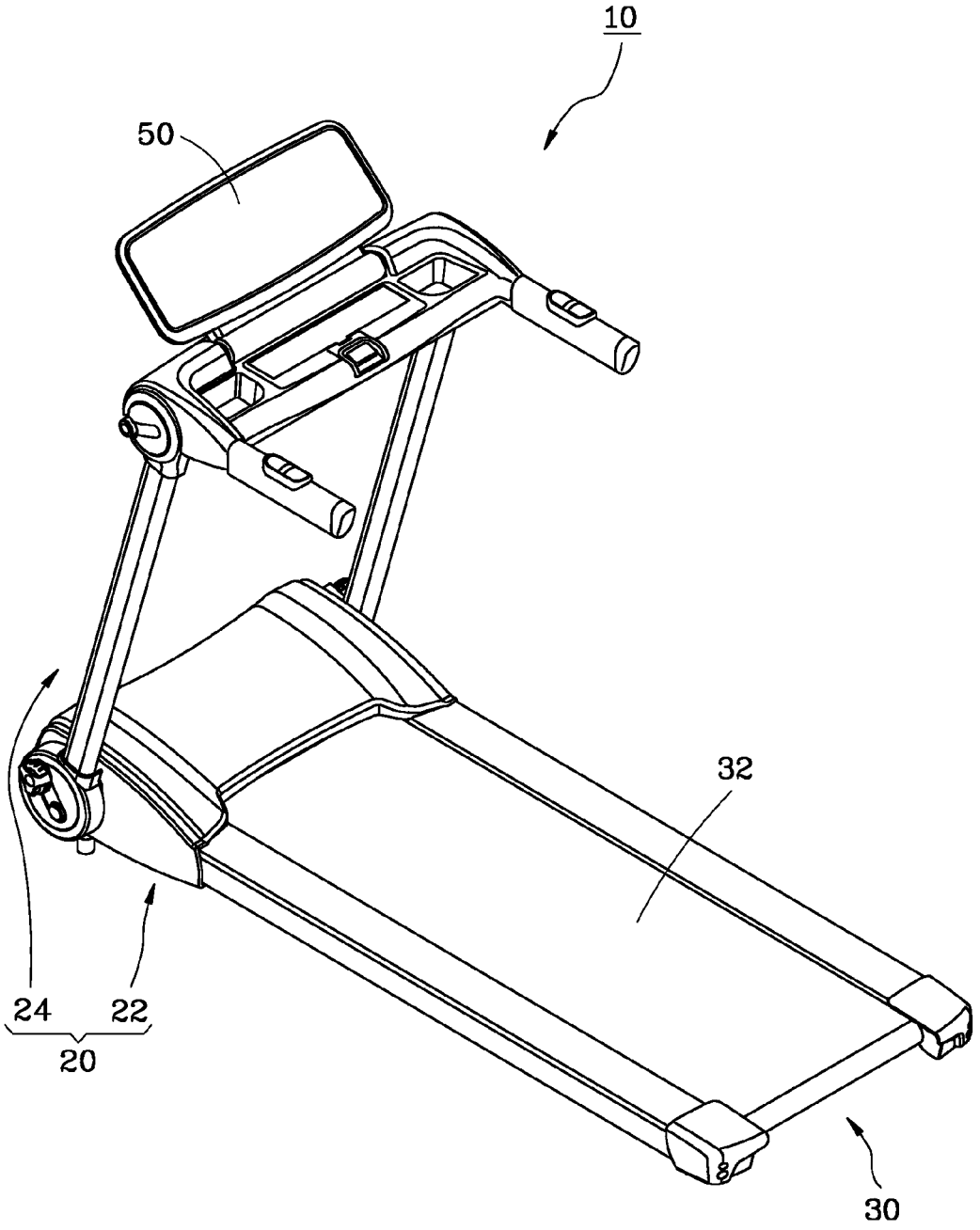
FIG. 1 is a perspective view of a preferred embodiment of the present invention.
Figure 2:
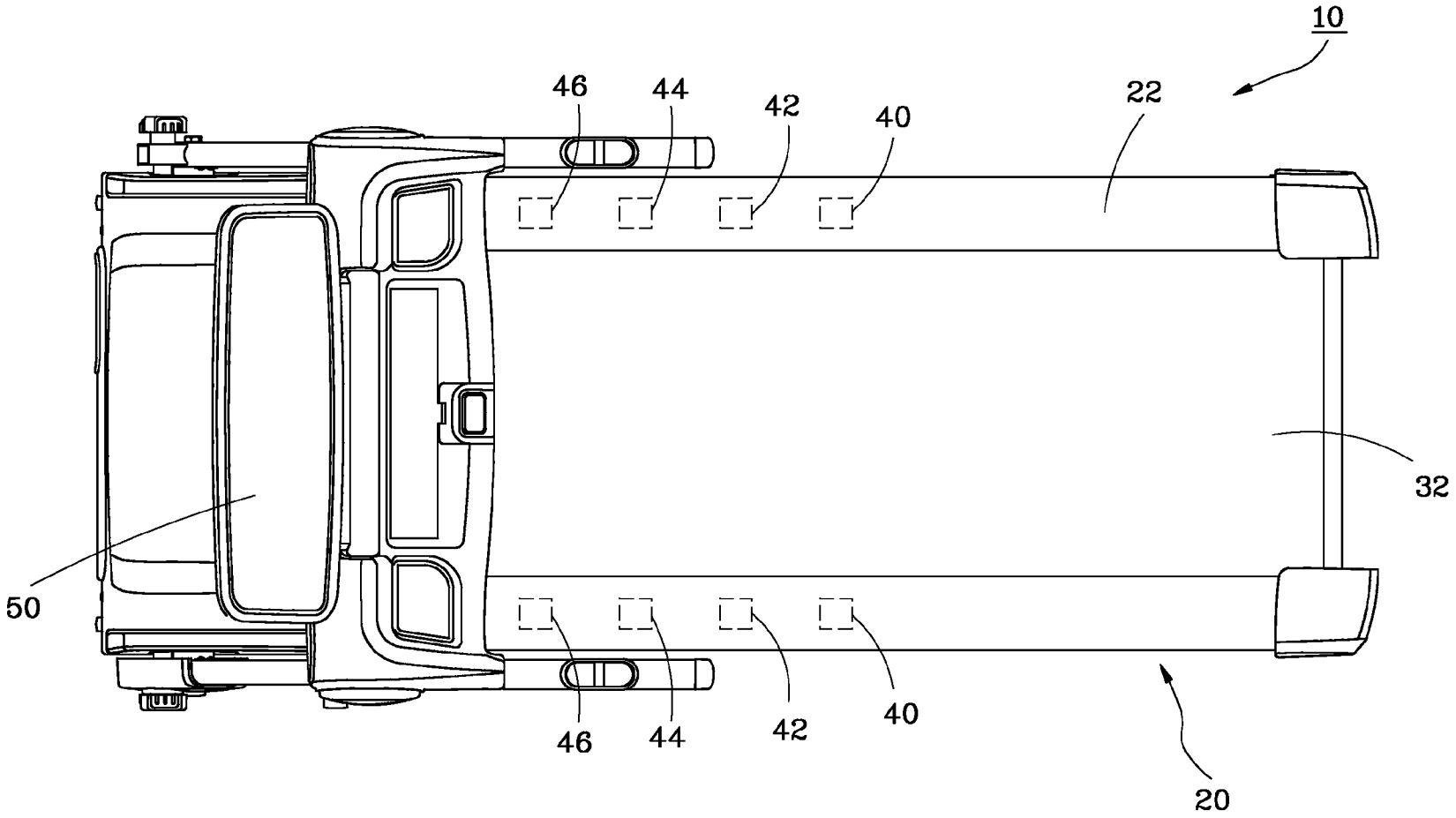
FIG. 2 is a top view of the preferred embodiment of the present invention.

Referring to FIGS. 1-2, a rehabilitation treadmill 10 constructed according to a preferred embodiment of the present invention is composed of a framework 20, a running platform 30, and four pairs of pace sensors 40, 42, 44, and 46. For the record, the number of the pace sensors is not limited to the four pairs but can be one pair or more pairs subject to different operation modes. The detailed descriptions and operations of these elements as well as their interrelations are recited in the respective paragraphs as follows.

The framework 20 includes a chassis 22 and a handrail stand 24. The chassis 22 is put on the ground for supporting the other components of the rehabilitation treadmill 10. The handrail stand 24 is mounted to a front end of the chassis 222 for the user's handhold.

The running platform 30 is mounted to the chassis 22 and includes a motor (not shown) and a running belt 32 connected with the motor. When the motor is activated, the running belt 32 is driven by the motor for operation.

The pace sensors 40, 42, 44, and 46 each are a photointerruptor, mounted to the chassis 22 and located at left and right sides of the running belt 32, respectively. Each two of the pace sensors 40, 42, 44, and 46 are arranged in pair and spaced from each other for detecting a pace start point or a pace stop point and corresponsively generating an activation signal or a stop signal, respectively.

The control panel 50 is mounted to the framework 20 and electrically connected with the running platform 30 for the user to configure a variety of parameters of the running platform 30, such as power switch, running velocity, running time, running distance, and gradient. The control panel 50 is electrically connected with the four pairs of the pace sensors 40, 42, 44, and 46 for receiving the activation or stop signal generated by each pair of the pace sensors 40, 42, 44, and 46 and controllably activating or stopping the running belt 32 subject to the activation or stop signal.

Figure 3:
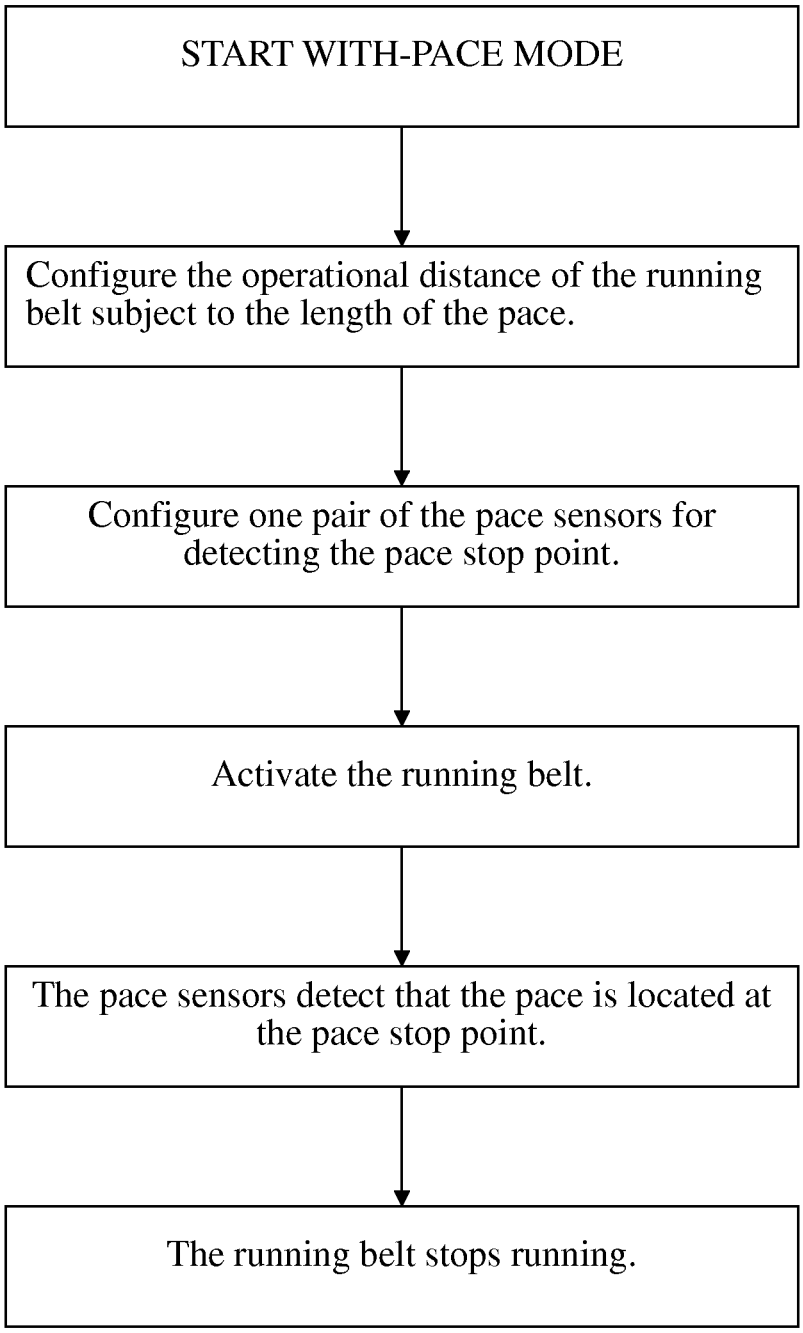
FIG. 3 is a flow chart of the preferred embodiment of the present invention, showing the operation in fixed-pace mode.

When it is intended to operate the control panel 50 to carry out a fixed-pace mode, as shown in FIGS. 2-3, the user can configure the operational distance of the running belt to make the operational distance of the running belt 32 be equal to the length of the user's pace; next, configure one pair of the pace sensors 40, 42, 44, and 46, e.g. the pace sensors 40, for detecting the pace stop point; next, according to the user's need, the user can decide whether to configure the operational time of the running belt 32. After all of the parameters indicated in the aforesaid steps are completely configured, the user can start to operate the rehabilitation treadmill 10. In the process of operation of the rehabilitation treadmill 10, the user can put one of his or her feet on the running belt 32 and then activate the running belt 32 to enable the foot to be moved backward as the running belt 32 is working. When the foot reaches the pace stop point, the pace sensors 40 can transmit the stop signal to the control panel 50 and then the control panel 50 can hereby stop the running belt 32; meanwhile, the user can put the other foot on the running belt for coordination with the running belt 32 and continue with the other aforesaid steps. In this way, repeating such operation again and again can reach the rehabilitational effect.

Figure 4:
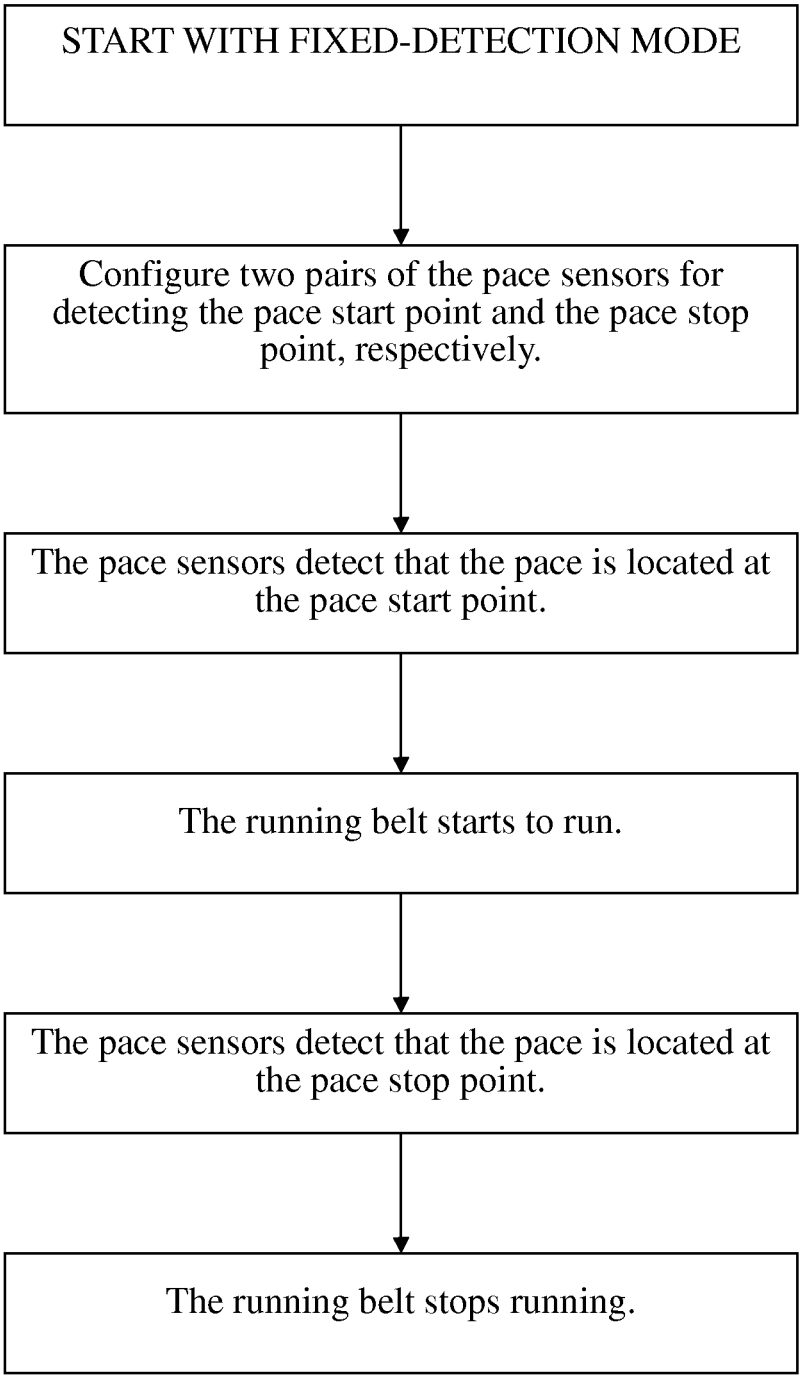
FIG. 4 is a flow chart of the preferred embodiment of the present invention, showing the operation in fixed-detection mode.

When it is intended to operate the control panel 50 to carry out a fixed-detection mode, as shown in FIGS. 2 and 4, the user can randomly configure one pair of the pace sensors, e.g. the pace sensors 46, for detecting the pace start point and then randomly configure the other pair of the pace sensors, e.g. the pace sensors 40, for detecting the pace stop point. When the user's one foot is put on the pace start pint, the pace sensors 46 can transmit the activation signal to the control panel 50 and the control panel 50 can hereby activate the running belt 32. When the user's foot is moved backward to the pace stop point as the running belt 32 is working, the pace sensors 40 can transmit the stop signal to the control panel 50 and the control panel 50 can hereby stop the running belt 32; in the meantime, the user can put the other foot on the pace start point, so the running belt 32 can be activated again to allow the user to make the next move.

Figure 5:
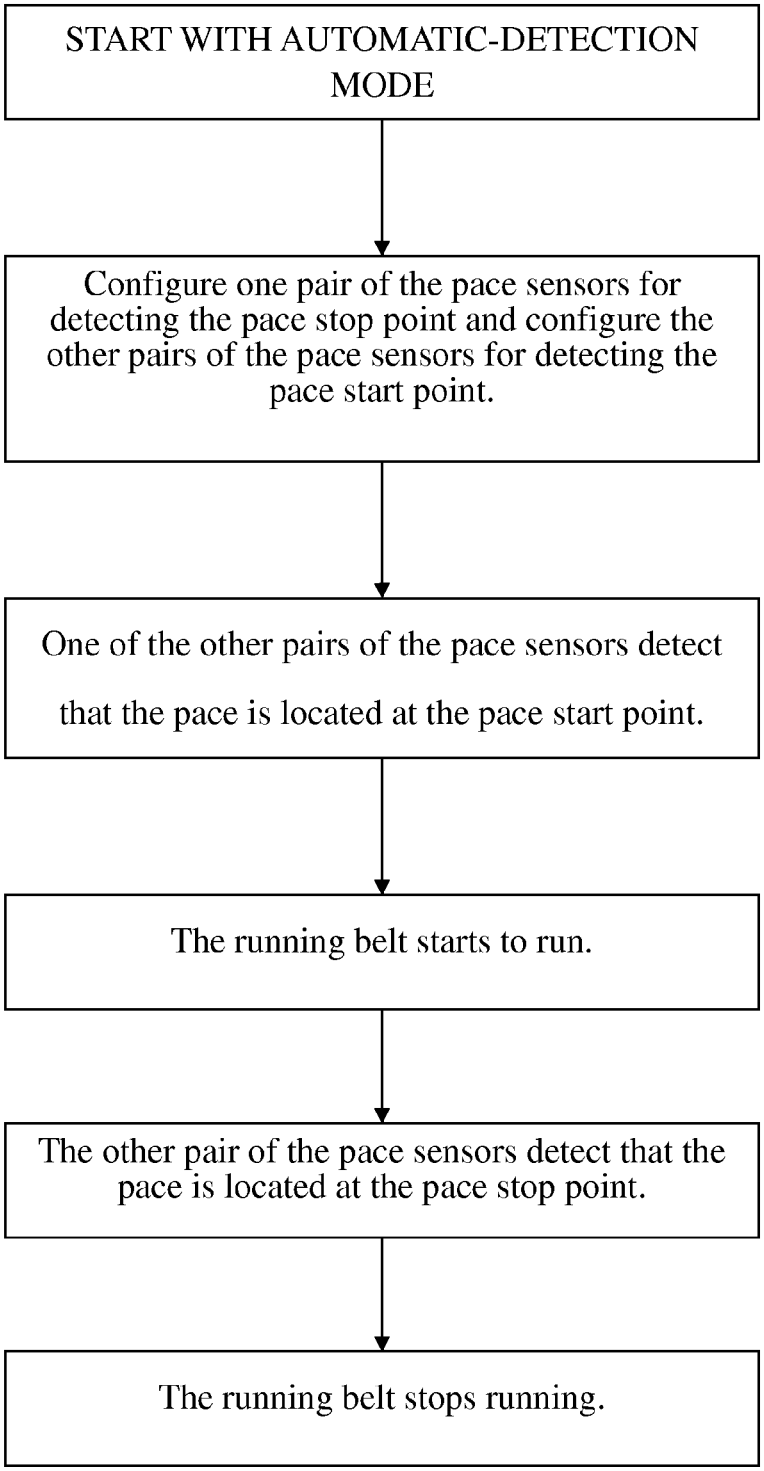
FIG. 5 is a flow chart of the preferred embodiment of the present invention showing the operation in automatic-detection mode.

Referring to FIG. 5 in view of FIG. 2, when it is intended to operate the control panel 50 to carry out an automatic-detection mode, the user can randomly configure one pair of the pace sensors, e.g. the pace sensors 40, for detecting the pace stop point via the control panel 50 and then configure the other three pairs of the pace sensors, e.g. the pace sensors 42, 44, and 46, for detecting the pace start point. In the process of the operation, when the user puts one foot on the pace start point corresponding to either of the pace sensors 42, 44, and 46, one pair of the pace sensors, e.g. the pace sensors 44, can transmit the activation signal to the control panel 50 and the control panel 50 can hereby activate the running belt 32. When the user's foot is moved backward to the pace stop point as the running belt is working, the pace sensors 40 can transmit the stop signal to the control panel 50 and meanwhile, the user can put another foot on the pace start point corresponding to either of the pace sensors 42, 44, and 46 in such a way that the running belt 32 can be activated again to allow the user to make the next move.

Figure 6:
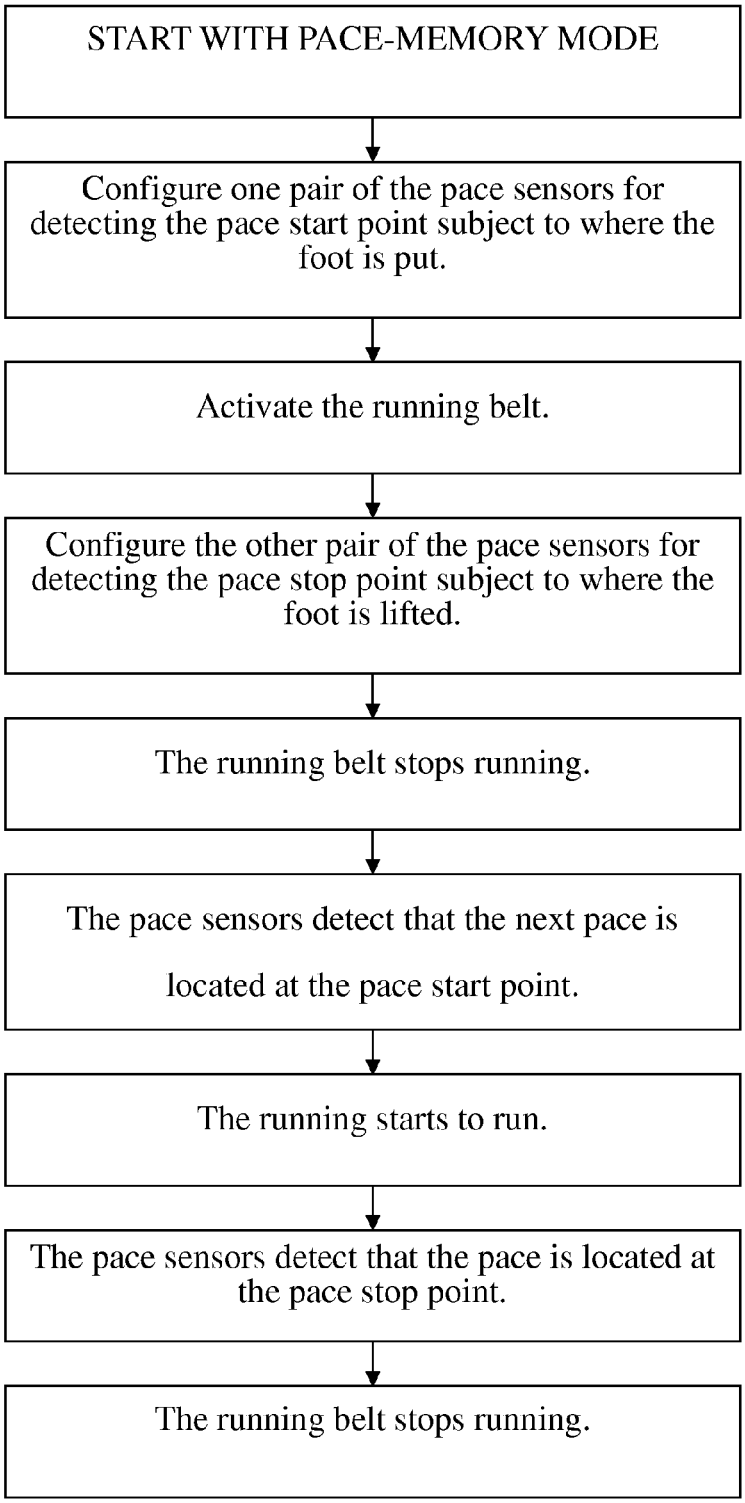
FIG. 6 is a flow char of the preferred embodiment of the present invention showing the operation in pace-memory mode.

Referring to FIG. 6 in view of FIG. 2, when it is intended to operate the control panel 50 to carry out a pace-memory mode, the user can put one of the feet thereof on a detectable position corresponding to one pair of the pace sensors, e.g. the pace sensor 46, and the detectable position can be set as the pace start point; next, the user can activate the running belt 32 and when the foot is moved to another detectable position corresponding to another pair of the pace sensors, e.g. the pace sensors 40, along with the operation of the running belt 32 and then the user intends to lift the foot, the detectable position can be set as the pace stop point; meanwhile, the control panel 50 can receive the stop signal to stop the running belt 32. In this way, the user only needs to repeatedly step with the feet on the running platform 30 between the two detectable positions to reach the rehabilitational effect.

In conclusion, the running belt 32 of the rehabilitation treadmill 10 of the present invention can be automatically activated or stopped subject to the user's pace through the placement of the pace sensors 40, 42, 44, and 46 and the modes executed by the control panel 50, so the chances that the inconveniently mobile person falls down can be effectively lowered to lead to safe operation.

What is claimed is:

1. A rehabilitation treadmill comprising:

a framework;

a running platform mounted to the framework and having an intermittently moveable running belt;

at least two pairs of pace sensors mounted to the framework and located at two sides of the running belt, wherein one pair of said pace sensors detects a pace start point to generate an activation signal and another pair of said pace sensors detects a pace stop point and generate a stop signal; and a control panel mounted to the framework and electrically connected with the running platform and said pace sensors, wherein the control panel receives the activation signal and the stop signal to activate and stop the running belt subject to the activation and stop signals, respectively and repeatedly, such that the running belt is intermittently operated.

2. The rehabilitation treadmill as defined in claim 1 comprising at least three pairs of said pace sensors, wherein one pair of said pace sensors can detect the pace stop point and the other pairs of said pace sensors can detect the pace start point.

3. The rehabilitation treadmill as defined in claim 1 comprising at least three pairs of said pace sensors, wherein two pairs of said pace sensors can detect the pace start point and the pace stop point, respectively.

4. The rehabilitation treadmill as defined in claim 1, wherein each of the pace sensors is a photointerruptor.

5. The rehabilitation treadmill as defined in claim 3, wherein each of the pace sensors is a photointerruptor.

6. A rehabilitation treadmill comprising:

a framework;

a running platform mounted to the framework and having an intermittently moveable running belt;

at least three pairs of pace sensors mounted to the framework and located at two sides of the running belt, wherein a first detectable position is detected by one pair of said pace sensors and set as a pace start point, and a second detectable position is detected by another pair of said pace sensors and set as a pace stop point; thereafter said one pair of said pace sensors detects the pace start point to generate an activation signal and said another pair of said pace sensors detects the pace stop point and generate a stop signal; and a control panel mounted to the framework and electrically connected with the running platform and said pace sensors, wherein the control panel receives the activation signal and the stop signal to activate and stop the running belt subject to the activation and stop signals, respectively and repeatedly, such that the running belt is intermittently operated.

* * * * *